US009409420B2

(12) United States Patent
O'Hara et al.

(10) Patent No.: US 9,409,420 B2
(45) **Date of Patent: *Aug. 9, 2016**

(54) RECIRCULATE AND FILTER AIR TO FORM AIR BARRIER IN IMAGE FORMING APPARATUS

(71) Applicant: HEWLETT-PACKARD DEVELOPMENT COMPANY, L.P., Houston, TX (US)

(72) Inventors: Steve A. O'Hara, Camas, WA (US); Christie Dyan Larson, Vancouver, WA (US); Kevin Lo, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/870,849

(22) Filed: Sep. 30, 2015

(65) Prior Publication Data

US 2016/0023482 A1 Jan. 28, 2016

Related U.S. Application Data

(63) Continuation of application No. 14/371,344, filed as application No. PCT/US2012/031700 on Mar. 30, 2012, now Pat. No. 9,180,709.

(51) Int. Cl.

| | |
|---|---|
| ***B41J 11/00*** | (2006.01) |
| ***B41J 11/02*** | (2006.01) |
| ***B41J 29/377*** | (2006.01) |
| ***B41J 2/165*** | (2006.01) |
| ***B41J 29/17*** | (2006.01) |

(52) U.S. Cl.
CPC ..... *B41J 11/0085* (2013.01); *B41J 2/165* (2013.01); *B41J 11/02* (2013.01); *B41J 29/17* (2013.01); *B41J 29/377* (2013.01)

(58) Field of Classification Search
CPC ..... B41J 29/17; B41J 29/377; B41J 2/165; B41J 11/0085; B41J 11/02
USPC ..... 347/34, 25
See application file for complete search history.

(56) References Cited

U.S. PATENT DOCUMENTS

| | | | |
|---|---|---|---|
| 5,519,420 | A | 5/1996 | Zorn et al. |
| 6,572,294 | B2 | 6/2003 | Beehler et al. |
| 6,890,053 | B2 | 5/2005 | Myhill et al. |

(Continued)

FOREIGN PATENT DOCUMENTS

| | | | |
|---|---|---|---|
| EP | 0604029 | A2 | 6/1994 |
| JP | 2006282296 | A | 10/2006 |

(Continued)

*Primary Examiner* — Henok Legesse
(74) *Attorney, Agent, or Firm* — HPInc. Patent Department

(57) ABSTRACT

An image forming apparatus includes a substrate receiving member, a fluid applicator unit, and an air recirculator assembly. The substrate receiving member may selectively receive a substrate. The fluid applicator unit may selectively eject a first set of drops to the substrate received by the substrate receiving member in a print mode and a second set of drops in a maintenance mode. The air recirculater assembly may direct air to form an air barrier across the print zone to redirect at least one of aerosol and particulates from crossing through the air barrier and onto the substrate, to filter the at least one of the aerosol and particulates to form filtered air, and to form the air barrier with the filtered air.

15 Claims, 6 Drawing Sheets

(56) References Cited

U.S. PATENT DOCUMENTS

| | | | | |
|---|---|---|---|---|
| 7,357,475 | B2 | 4/2008 | Silverbrook | |
| 7,571,996 | B2 | 8/2009 | Domoto et al. | |
| 7,604,332 | B2 | 10/2009 | Nagashima | |
| 9,180,709 | B2 * | 11/2015 | O'Hara | B41J 29/17 |
| 2003/0016267 | A1 | 1/2003 | Green | |

FOREIGN PATENT DOCUMENTS

| | | | |
|---|---|---|---|
| JP | 2009-012184 | A | 1/2009 |
| JP | 4551357 | B2 | 9/2010 |
| KR | 10-0313866 | B1 | 2/2002 |
| KR | 10-2011-0093136 | A | 8/2011 |
| SG | 152033 | A1 | 5/2009 |

* cited by examiner

RECIRCULATE AND FILTER AIR TO FORM AIR BARRIER IN IMAGE FORMING APPARATUS

This application is a continuation of U.S. patent application Ser. No. 14/371,344, filed Jul. 9, 2014, currently allowed, which is a 371 of International Application PCT/US2012/031700, filed on Mar. 30, 2012, which is herein incorporated by reference in its entirety.

BACKGROUND

Image forming apparatuses may include fluid applicator units to eject fluid such as ink in the form of drops on substrates. The image forming apparatuses may form an air barrier to reduce an amount of aerosol, particulates, and the like, from being deposited on the substrate, fluid applicator unit, and/or other components of the image forming apparatuses.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming apparatuses may include fluid applicator units to eject fluid such as ink in the form of drops on substrates. The image forming apparatuses may form an air barrier to reduce an amount of aerosols, particulates, and the like, from being deposited on the substrate, fluid applicator unit, and/or other components of the image forming apparatuses. The image forming apparatuses may also periodically perform maintenance procedures to maintain flow paths within the fluid applicator units in order to properly eject drops there from. That is, in a maintenance mode, the fluid applicator unit may periodically perform spitting procedures in which fluid is ejected from the fluid applicator unit in the form of drops there from. The drops ejected from the fluid application units, however, may form aerosol which, if not properly removed, may contaminate the substrate and/or components of the image forming apparatuses. Further, aerosol can cloud optical sensors causing premature failure, increase friction in rotating members, deposit on media path surfaces increasing friction and potentially causing a leak out of the image forming apparatus dirtying both the interior and surroundings. In addition, the combination of aerosol with other particulates can interact to increase these issues by forming sticky, globular masses. Further, particulates such as dust, paper debris, and the like, may also contaminate the substrate. Thus, the aerosol and/or particulates may cause image defects, component malfunctions, and/or reduce the lifespan of the image forming apparatuses.

In examples, an image forming apparatus includes, amongst other things, a substrate receiving member, a fluid applicator unit, and an air recirculator assembly. The fluid applicator unit may selectively eject a first set of drops to the substrate received by the substrate receiving member in a print mode and a second set of drops in a maintenance mode. The air recirculater assembly may direct air to form an air barrier across the print zone to redirect at least one of aerosol and particulates from crossing through the air barrier and onto the substrate, to filter the at least one of the aerosol and particulates to form filtered air, and to form the air barrier with the filtered air. Accordingly, adequate redirection and extraction of aerosol and/or particulates may be effectively performed. Additionally, the substrate may be prevented from contacting a surface of the fluid applicator unit. Thus, image forming defects, component malfunctions, and the reduction in the lifespan of the image forming apparatus may be reduced.

Figure 1:
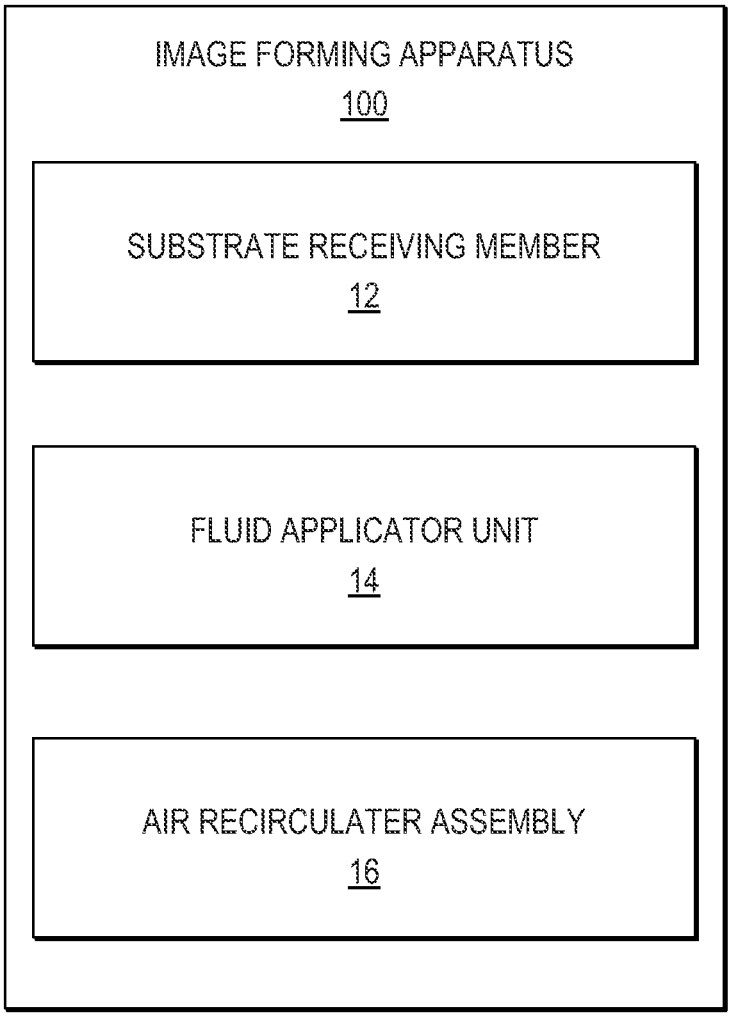
FIG. 1 is a block diagram of an image forming apparatus according to an example.

FIG. 1 is block diagram of an image forming apparatus according to an example. Referring to FIG. 1, in some examples, an image forming apparatus 100 includes a substrate receiving member 12, a fluid applicator unit 14, and an air recirculater assembly 16. The substrate receiving member 12 may selectively receive a substrate. That is, the substrate may be transported along a substrate transport path to be placed on the substrate receiving member 12. The substrate may include media such as paper, vinyl, plastic, cloth, and the like. In some examples, different-sized substrate may be received by the substrate receiving member 12. The substrate receiving member 12 may be a platen, and the like.

Referring to FIG. 1, in some examples, the fluid applicator unit 14 may selectively eject a first set of drops to the substrate disposed on the substrate receiving member 12 in a print mode. The fluid applicator unit 14 may also selectively eject a second set of drops in a maintenance mode. That is, the print mode is a mode in which a first set of drops of fluid are ejected by the fluid applicator unit 14 onto the substrate. For example, the first set of drops may form images on the substrate. Alternatively, the maintenance mode is a mode in which a second set of drops of fluid are ejected by the fluid applicator unit 14 to maintain flow paths in the fluid applicator unit 12 for proper ejection of subsequent first set of drops there from.

In some examples, the fluid applicator unit 14 may include at least one inkjet print head to eject ink in the form of drops. For example, the fluid applicator unit 14 may be a page wide inkjet print head array that includes a plurality of inkjet print heads that extend across a width of a substrate transport path. That is, the plurality of inkjet print heads may extend across a width of a substrate passing into a print zone and disposed on the substrate receiving member 12. The fluid applicator unit 14 and the substrate receiving member 12 may form a print zone there between. The air recirculater assembly 16 may direct air to form an air barrier across the print zone to redirect at least one of aerosol and particulates from crossing through the air barrier and onto the substrate. The air recirculater assembly 16 may also filter the at least one of the aerosol and particulates to form filtered air. The air recirculater assembly 16 may also form the air barrier with the filtered air. Additionally, the substrate may be prevented from contacting a surface of the fluid applicator unit 14.

Figure 2A:
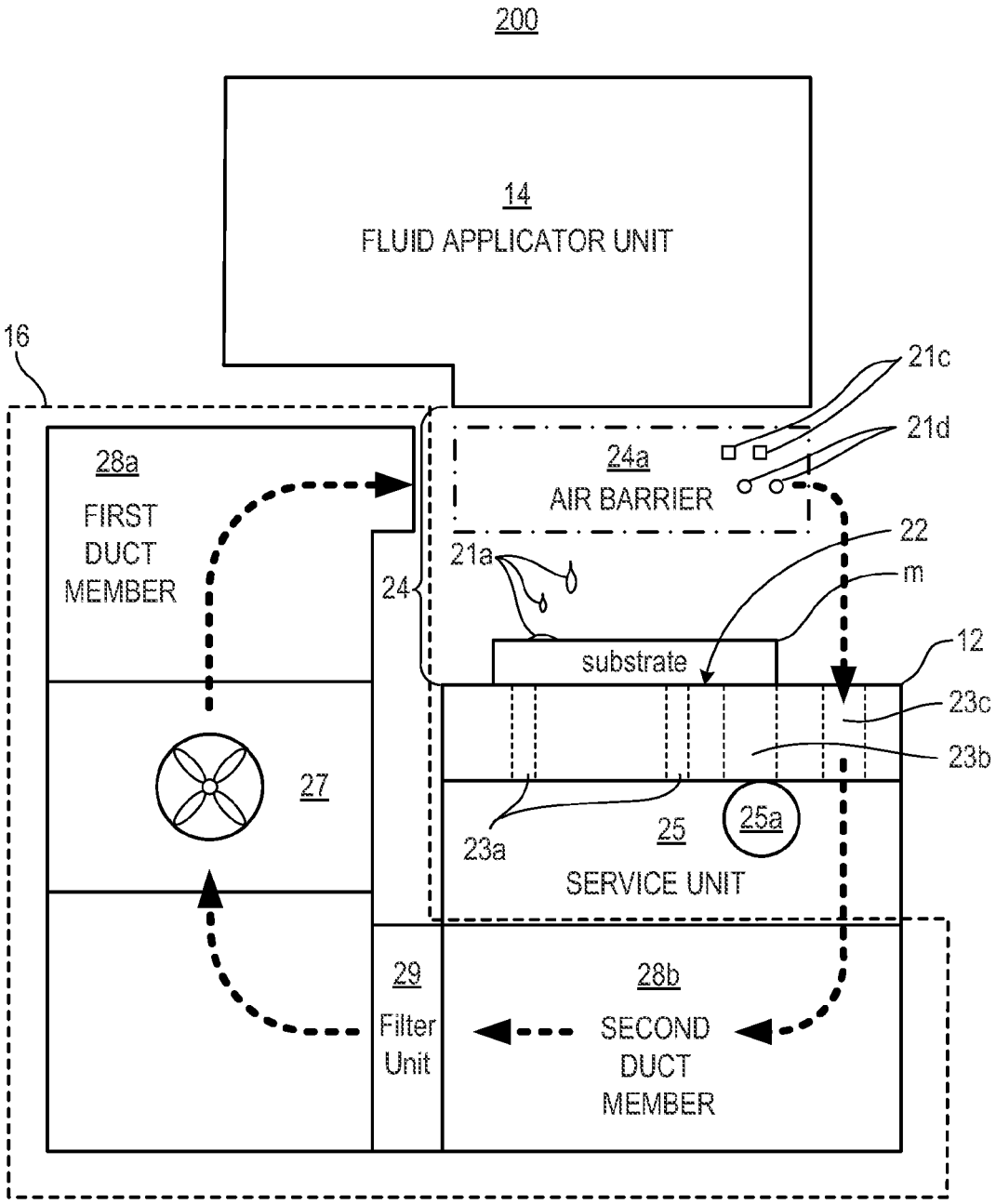
FIG. 2A is a schematic side view of an image forming apparatus in a print mode according to an example.
Figure 2B:
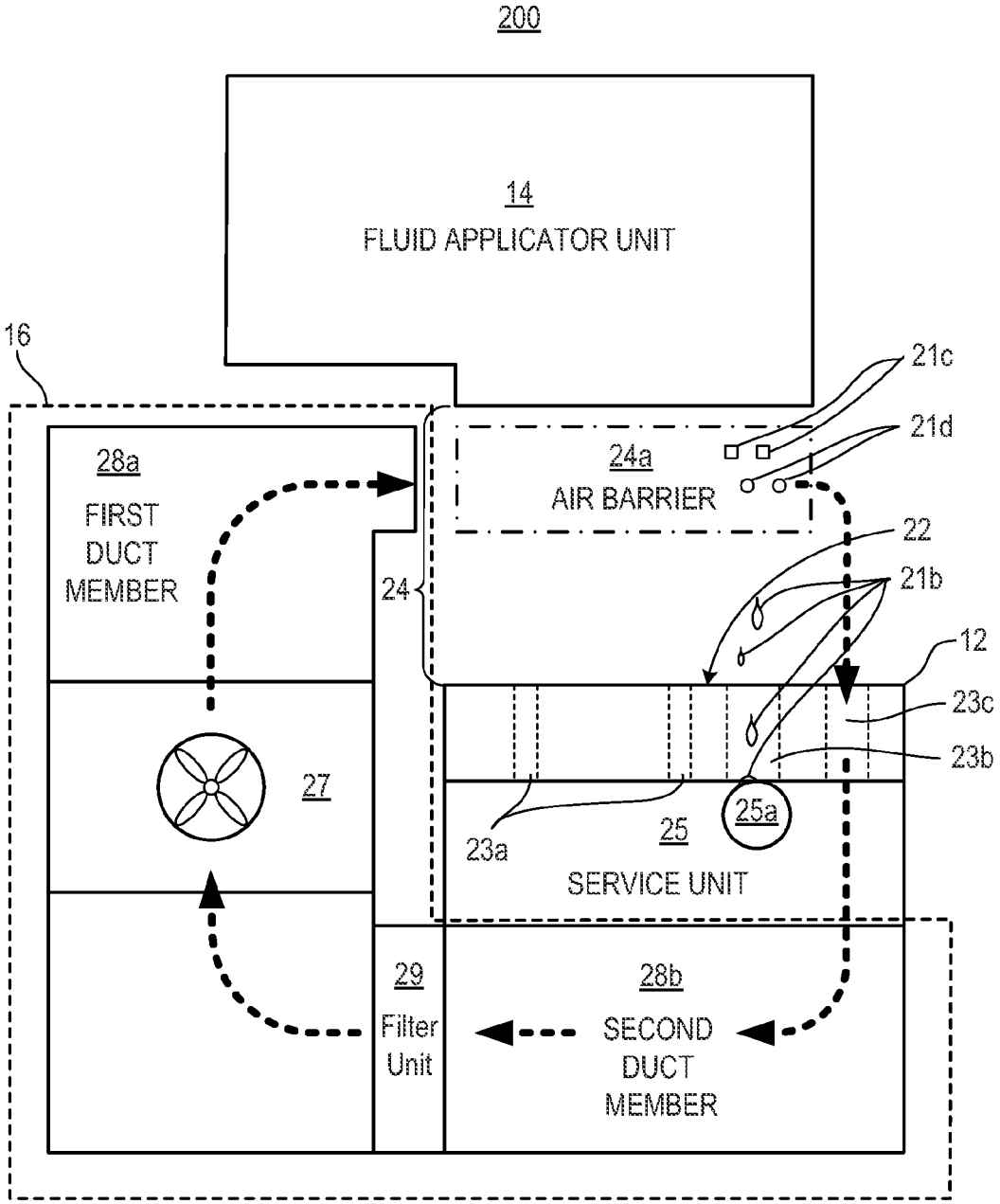
FIG. 2B is a schematic side view of an image forming apparatus in a maintenance mode according to an example.

FIG. 2A is a schematic side view of an image forming apparatus in a print mode according to an example. FIG. 2B is a schematic side view of an image forming apparatus in a maintenance mode according to an example. Referring to FIGS. 2A and 2B, in some examples, an image forming apparatus 200 may include a substrate receiving member 12, a fluid applicator unit 14, and an air recirculater assembly 16 as previously disclosed with respect to the image forming apparatus 100 of FIG. 1. In some examples, the image forming apparatus 200 may also include a service unit 25. The service unit 25 may receive at least one of the second set of drops 21*b* and the at least one of the aerosol 21*c* and particulates 21*d*. In some examples, the service unit 25 may include a maintenance member 25*a* to collect at least one of the second set of drops 21*b* and the at least one of the aerosol 21*c* and particulates 21*d*. For example, the maintenance member 25*a* may be in a form of a spit roller, and the like.

Referring to FIGS. 2A and 2B, in some examples, in the maintenance mode, the substrate m does not cover the at least one maintenance opening 23*b* (e.g., the substrate m moved from or not yet received on the substrate receiving area 22) and the second set of drops 21*b* ejected from the fluid applicator unit 14 pass through the maintenance opening 23*b* and onto the maintenance member 25*a* as illustrated in FIG. 2B. In some examples, the air recirculater assembly 16 may include a filter unit 29 and an airflow unit 27, 28*a* and 28*b*. The filter unit 29 may filter the at least one of the aerosol 21*c* and particulates 21*d* from the air. That is, the filter unit 29 is able to remove a large percentage of aerosol and particulates before the air flow moves to the first duct member 28*a*. In some examples, the filter unit 29 may include an aerosol filter, and the like. For example, the filter unit 29 may include at least one of needlefelt, polyester, open cell, closed cell, pleated, charged, and the like.

Referring to FIGS. 2A and 2B, in some examples, the airflow unit 27, 28*a* and 28*b* may direct the air to pass through the filter unit 29 to form the filtered air and direct the filtered air to form the air barrier 24*a*. In some examples, the air may be directed by the fan 27 in multiple paths to subsequently meet to form the air barrier 24*a*. The airflow unit 27, 28*a* and 28*b* may include a fan 27, a first duct member 28*a* and a second duct member 28*b*. The fan 27 may suck the air forming the air barrier 24*a* including the at least one of the aerosol 21*c* and particulates 21*d* through the filter unit 29 to form the filtered air. The fan 27 may also push the filtered air across the print zone 24 to form the air barrier 24*a*. The first duct member 28*a* may be disposed between the fan 27 and the print zone 24. The first duct member 28*a* may form a first channel to guide the filtered air from the fan 27 to the print zone 24. The second duct member 28*b* may be disposed between the fan 27 and the substrate receiving member 12 to form a second channel to guide the air to the fan 27. In some examples, the filter unit 29 may be disposed in the second duct member 28*b*.

Figure 3:
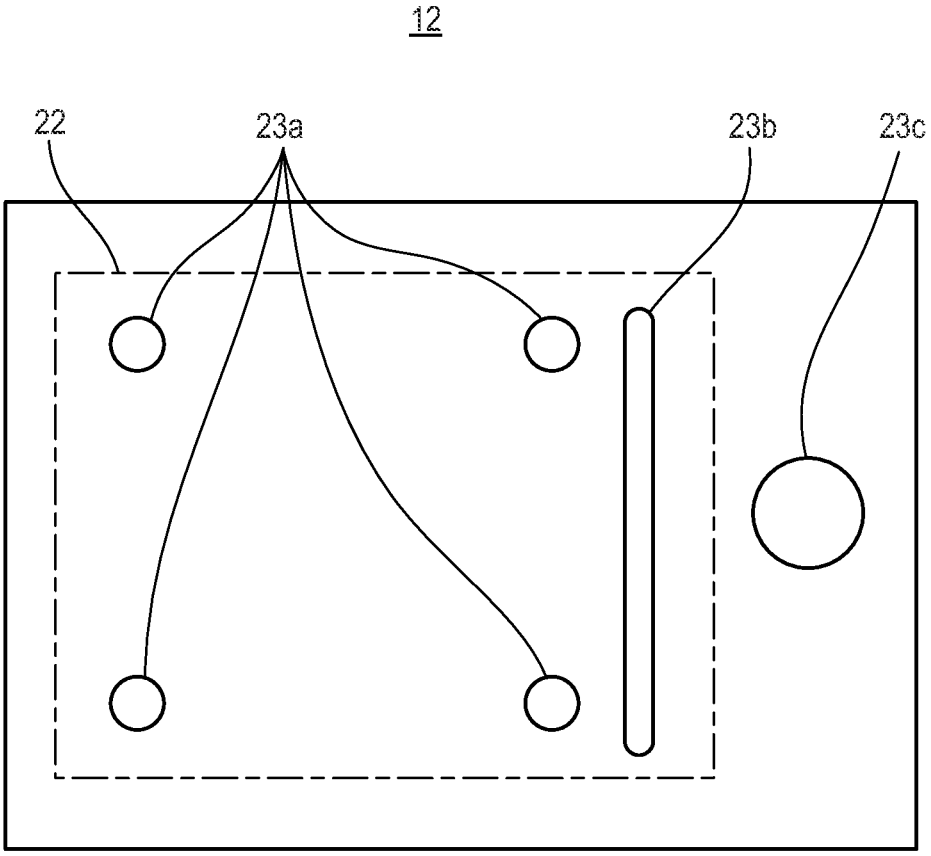
FIG. 3 is a top view of a substrate receiving member of the image forming apparatus of FIG. 2B according to an example.

FIG. 3 is a top view of a substrate receiving member of the image forming apparatus of FIG. 2B according to an example. Referring to FIGS. 2B and 3, in some examples, a substrate receiving member 12 may also include a substrate receiving area 22 to receive the substrate m and at least one recirculation opening 23*c* for the air to pass through the substrate receiving member 12 to the second duct member 28*b*. For example, the recirculation opening 23*c* may allow a continuous path of air to and from the fan 27 to filter the air to remove the aerosol and/or particulates there from and for the filtered air to form the air barrier 24*a*. Recirculation of the air flow provides additional filtering of the air as it makes air flow in the system closed-loop to a large extent. Even if the aerosol makes it through the filter unit 29 during an initial pass, it is likely that it will be impacted onto maintenance member 25A. In some examples, this process will repeat continuously as long as the fan 27 is running. In some examples, the substrate receiving area 22 may also include a plurality of positioning holes 23*a* and at least one maintenance hole 23*b*. The plurality of positioning holes 23*a* may enable the fan 27 to suck the air to selectively hold the substrate m against the substrate receiving area 22 in the print mode.

Referring to FIGS. 2A, 2B and 3, in some examples, the at least one maintenance hole 23*b* may allow the second set of drops 21*b* selectively ejected from the fluid applicator unit 14 to pass through the substrate receiving member 12 to the maintenance member 25*a* of the service unit 25. In some examples, the substrate m may uncover the at least one maintenance hole 23*b* to enable the second set of drops 21*b* to be received by the service unit 25 and/or contact the maintenance member 25*a*. That is, the second set of drops 21*b* may be selectively ejected in the maintenance mode before the substrate m is received by or after the substrate m is moved from the substrate receiving area 22 of the substrate receiving member 12.

Figure 4:
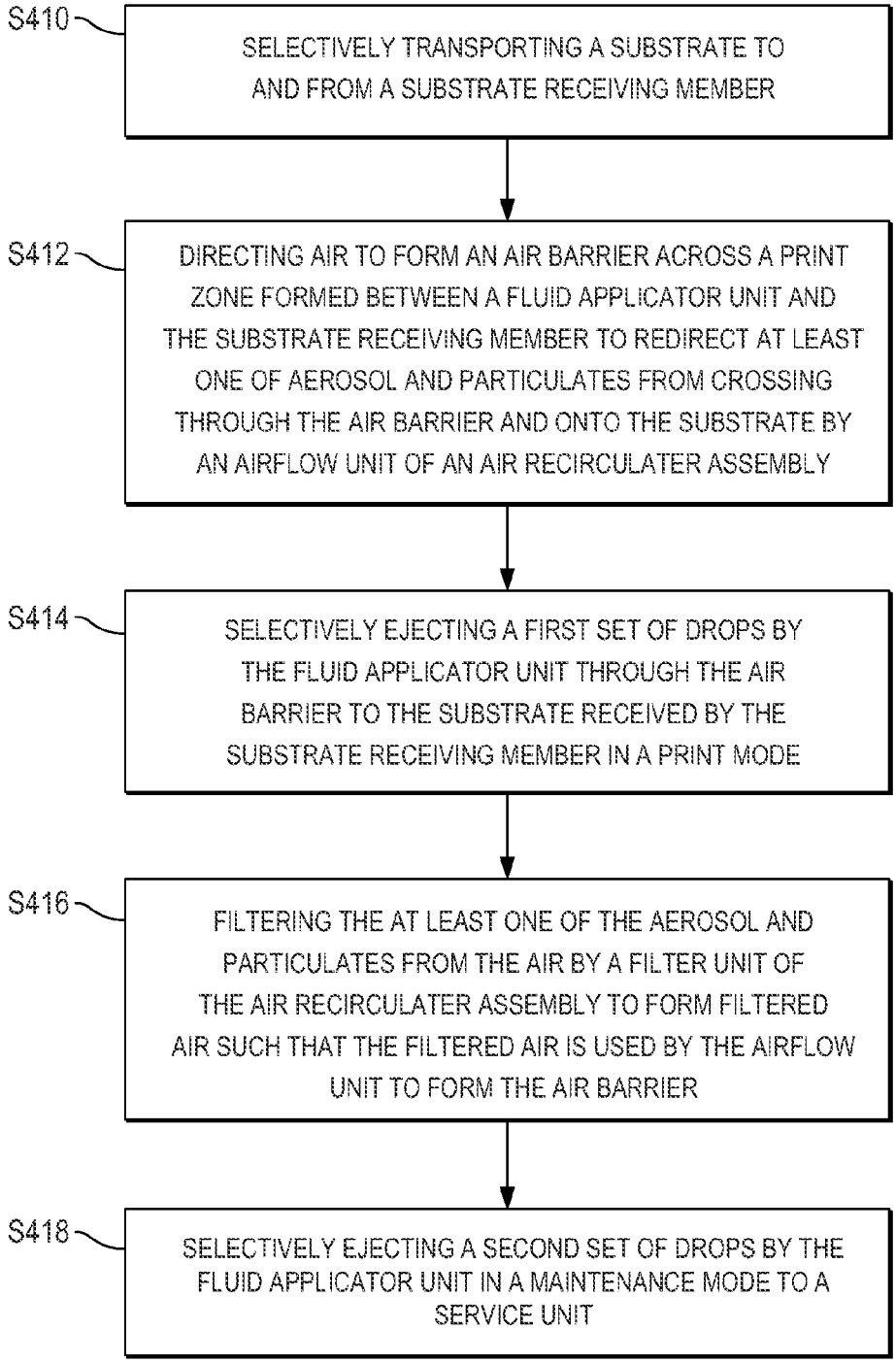
FIG. 4 is a flowchart illustrating a method of recirculating air in an image forming apparatus according to an example.

FIG. 4 is a flowchart illustrating a method of recirculating air in an image forming apparatus according to an example. Referring to FIG. 4, in block S410, a substrate is selectively transported to and from a substrate receiving member. In block S412, air is directed by an airflow unit of an air recirculater assembly to form an air barrier across a print zone formed between a fluid applicator unit and the substrate receiving member to redirect at least one of aerosol and particulates from crossing through the air barrier and onto the substrate. For example, filtered air may be pushed across the print zone by a fan to form the air barrier. In block S414, a first set of drops is selectively ejected by the fluid applicator unit through the air barrier to the substrate received by the substrate receiving member in a print mode.

Referring to FIG. 4, in block S416, the at least one of the aerosol and particulates is filtered from the air by a filter unit of the air recirculater assembly to form filtered air. For example, the air forming the air barrier including the at least one of the aerosol and particulates may be sucked through the filter unit by a fan to form the filtered air. That is, the air forming the air barrier may be passed through at least one recirculation opening disposed through the substrate receiving member and through the filter unit. In some examples, the filtered air may be used by the airflow unit to form the air barrier. In block S418, a second set of drops is selectively ejected by the fluid applicator unit in a maintenance mode to a service unit. For example, the second set of drops ejected from the fluid applicator unit may be ejected through at least one maintenance hole disposed through the substrate receiving member to a maintenance member of the service unit. In some examples, operations S410 to S418 may be continuously repeated, for example, while the image forming apparatus is turned on, in a printing mode, and/or in a maintenance mode.

Figure 5:
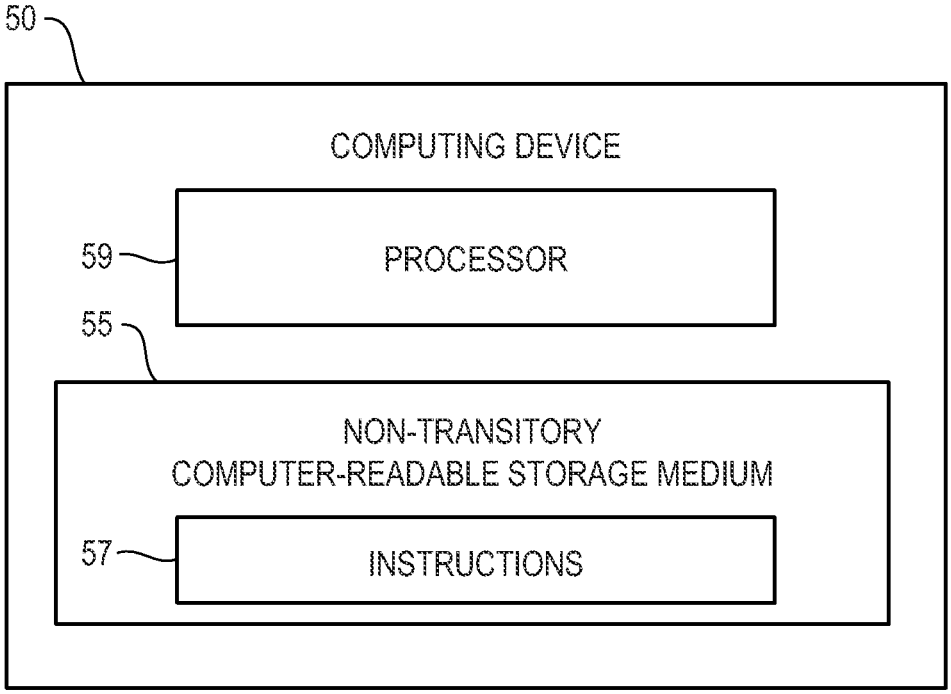
FIG. 5 is a block diagram illustrating a computing device such as an image forming apparatus including a processor and a non-transitory, computer-readable storage medium to store instructions to operate the computing device to recirculate air according to an example.

FIG. 5 is a block diagram illustrating a computing device such as an image forming apparatus including a processor and a non-transitory, computer-readable storage medium to store instructions to operate the computing device to recirculate air according to an example. Referring to FIG. 5, in some examples, the non-transitory, computer-readable storage medium 55 may be included in a computing device 50 such as an image forming apparatus 100 and 200. In some examples, the non-transitory, computer-readable storage medium 55 may be implemented in whole or in part as computer-implemented instructions stored in the image forming apparatus 100 and 200 locally or remotely, for example, in a server or a host computing device considered herein to be part of the image forming apparatus 100 and 200.

Referring to FIG. 5, in some examples, the non-transitory, computer-readable storage medium 55 may correspond to a storage device that stores computer-implemented instructions, such as programming code, and the like. For example, the non-transitory, computer-readable storage medium 55 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 5, examples of storage devices include, but are not limited to, hard disk drives, compact disc drives, digital versatile disc drives, optical drives, and flash memory devices. In some examples, the non-transitory, computer-readable storage medium 55 may even be paper or another suitable medium upon which the instructions 57 are printed, as the instructions 57 can be electronically captured, via, for instance, optical scanning of the paper or other medium, then compiled, interpreted or otherwise processed in a single manner, if necessary, and then stored therein. A processor 59 generally retrieves and executes the instructions 57 stored in the non-transitory, computer-readable storage medium 55, for example, to operate a computing device 50 such as an image forming apparatus 100 and 200 to recirculate air in accordance with an example. In an example, the non-transitory, computer-readable storage medium 55 can be accessed by the processor 59.

It is to be understood that the flowchart of FIG. 4 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be scrambled relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. An image forming apparatus, comprising:
- a substrate receiving member that forms:
  - a plurality of positioning holes; and
  - a recirculation opening for air to pass through the substrate receiving member;
- a fluid applicator unit to eject a set of drops to a substrate received by the substrate receiving member, the fluid applicator unit and the substrate receiving member to form a print zone; and
- an air recirculater assembly to:
  - suck air through the plurality of positioning holes to hold the substrate against a substrate receiving area;
  - direct air to form an air barrier across the print zone, the air barrier to:
    - redirect at least one of aerosols or particulates from crossing through the air barrier and onto the substrate; and
  - filter the at least one of the aerosols or the particulates to form filtered air.

2. The image forming apparatus according to claim 1, wherein the air recirculater assembly further comprises:
- a filter unit to filter the at least one of the aerosols or the particulates from the air.

3. The image forming apparatus according to claim 2, wherein the air recirculater assembly further comprises:
- an airflow unit to direct the air to pass through the filter unit to form the filtered air and to direct the filtered air to form the air barrier.

4. The image forming apparatus according to claim 3, wherein the airflow unit comprises:
- a fan to suck the air including the at least one of the aerosols or the particulates through the filter unit to form the filtered air and to push the filtered air across the print zone to form the air barrier.

5. The image forming apparatus according to claim 4, wherein the airflow unit further comprises:
- a first duct member disposed between the fan and the print zone, the first duct member to form a first channel to guide the filtered air from the fan to the print zone.

6. The image forming apparatus according to claim 5, wherein a second duct member is disposed between the fan and the substrate receiving member to form a second channel to guide the air to the fan.

7. The image forming apparatus according to claim 6, wherein the filter unit is disposed in the second duct member.

8. The image forming apparatus according to claim 1, wherein the fluid applicator unit comprises a page wide inkjet print head array.

9. A method of recirculating air in an image forming apparatus, the method comprising:
- transporting a substrate onto a substrate receiving member;
- directing air to form an air barrier across a print zone formed between a fluid applicator unit and the substrate receiving member to redirect at least one of aerosols or particulates from crossing through the air barrier and onto the substrate by an airflow unit of an air recirculater assembly, wherein the directing comprises:
  - passing the air through the substrate receiving member via a recirculation opening of the substrate receiving member to the air recirculater assembly; and
  - sucking the air to hold the substrate against the substrate receiving member via the air recirculater assembly and a plurality of positioning holes formed by the substrate receiving member;

ejecting a set of drops by the fluid applicator unit through the air barrier to the substrate when the substrate is on the substrate receiving member; and filtering the at least one of the aerosols or the particulates from the air by a filter unit of the air recirculater assembly to form filtered air.

10. The method according to claim 9, wherein the filtering the at least one of the aerosols or the particulates from the air further includes sucking the air including the at least one of the aerosols or the particulates through the filter unit by a fan of the air recirculater assembly to form the filtered air.

11. The method according to claim 10, wherein the directing air to form the air barrier further includes pushing the filtered air across the print zone by the fan to form the air barrier.

12. The method according to claim 11, wherein the filter unit is disposed in a duct member disposed between the fan and the substrate receiving member to form a channel to guide the air to the fan.

13. A non-transitory computer-readable storage medium storing instructions that are executable by a processor of an image forming apparatus to:

transport a substrate onto a substrate receiving area of a substrate receiving member;

form an air barrier across a print zone formed between a fluid applicator unit and the substrate receiving member to redirect at least one of aerosols or particulates from crossing through the air barrier and onto the substrate by an airflow unit of an air recirculater assembly by:

passing the air through the substrate receiving member via at least one recirculation opening of the substrate receiving member to the air recirculater assembly;

sucking the air to hold the substrate against the substrate receiving area via the air recirculater assembly and enabled by a plurality of positioning holes formed by the substrate receiving member; and filtering the at least one of the aerosols or the particulates from the air via a filter unit of the air recirculater assembly to form filtered air, wherein the filtered air is used by the airflow unit to form the air barrier; and eject a set of drops via the fluid applicator unit through the air barrier to the substrate when the substrate is on the substrate receiving member.

14. The non-transitory computer-readable storage medium according to claim 13, wherein the instructions are further executable by the processor to:

filter the at least one of the aerosols or the particulates from the air by sucking the air including the at least one of the aerosols or the particulates through the filter unit by a fan to form the filtered air.

15. The non-transitory computer-readable storage medium according to claim 14, wherein the instructions are further executable by the processor to:

direct the air to form the air barrier by pushing the filtered air across the print zone by the fan to form the air barrier.

* * * * *